US006788262B1

(12) United States Patent
Adams et al.

(10) Patent No.: US 6,788,262 B1
(45) Date of Patent: Sep. 7, 2004

(54) ULTRA-BROADBAND ANTENNA INCORPORATED INTO A GARMENT WITH RADIATION ABSORBER MATERIAL TO MITIGATE RADIATION HAZARD

(75) Inventors: Richard C. Adams, Chula Vista, CA (US); Daryl Von Mueller, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 149 days.

(21) Appl. No.: 10/263,943

(22) Filed: Oct. 3, 2002

Related U.S. Application Data

(63) Continuation-in-part of application No. 10/061,639, filed on Jan. 31, 2002, now Pat. No. 6,590,540.

(51) Int. Cl.[7] ..... H01Q 1/12
(52) U.S. Cl. ..... 343/718; 343/897
(58) Field of Search ..... 343/700 MS, 718, 343/897

(56) References Cited

U.S. PATENT DOCUMENTS 6,259,399 B1 * 7/2001 Krasner ..... 342/357.06
6,377,216 B1 * 4/2002 Cheadle et al. ..... 343/700 MS
6,483,469 B2 * 11/2002 Boyle ..... 343/718
6,590,540 B1 * 7/2003 Adams et al. ..... 343/718

* cited by examiner

*Primary Examiner*—Shih-Chao Chen
(74) *Attorney, Agent, or Firm*—Celia C. Dunham; Michael A. Kagan; Andrew J. Cameron

(57) ABSTRACT

An ultra-broadband antenna incorporated into an electrically nonconductive garment, with radiation absorber material to mitigate radiation hazard. The antenna includes first and second RF elements attached to the garment so that a gap exists between them, where the RF elements each form a band when the garment is worn by a wearer. RF and ground feeds are electrically connected to the first and second RF elements, respectively. A shorting strap electrically connected between the first and second RF elements on the anterior side of the garment generally opposite the feeds helps match the antenna impedance to an external signal source. Radiation absorber material disposed over the gap between the first and second RF elements and in a pocket in the region of the RF feed limits the wearer's exposure to electromagnetic field to acceptable levels.

3 Claims, 5 Drawing Sheets

ULTRA-BROADBAND ANTENNA INCORPORATED INTO A GARMENT WITH RADIATION ABSORBER MATERIAL TO MITIGATE RADIATION HAZARD

CROSS REFERENCES TO RELATED APPLICATIONS

This application is a continuation-in-part of U.S. patent application Ser. No. 10/061,639, entitled ULTRA-BROADBAND ANTENNA INCORPORATED INTO A GARMENT, filed on 31 Jan. 2000, now U.S. Pat. No. 6,590,540, and which is herein incorporated by reference.

BACKGROUND OF THE INVENTION

This invention relates generally to the field of antennas. More specifically, this invention relates to an ultra-broadband antenna that is incorporated into a garment that may be worn around a human torso and uses radiation absorber material to mitigate radiation hazards.

Soldiers today have a need to communicate many different types of information that may include global positioning information, voice signals, video, and technical data. Most antennas of hand-held radios used by soldiers for tactical operations are monopoles or dipoles that extend from a radio carried by the soldier. Such antennas have many disadvantages. For example, monopole antennas are narrowband and provide efficient operation over only a small frequency range. However, broadband antennas are needed to accommodate frequency-hopping systems that resist jamming. Some commercial antennas are excellent for several frequency bands but are useless at any other frequency. For frequency-hopping systems, efficiency is required in a wide band of contiguous frequencies. Thus, it may be appreciated that collectively, a soldier needs to have wideband communication capabilities. Monopole antennas do not provide such broadband operating capability. Also, monopole antennas are clumsy and tend to snag on trees, brush and low ceilings. Most importantly, the monopole antennas provide a visible signature that distinguishes the radio operator and any accompanying officer nearby, making them vulnerable to sniper fire. Because disruption of command, communications, and control is a paramount goal of snipers, reduction of the visual signature of an antenna is highly desirable. Therefore, a need exists for a broadband, man-carried antenna that does not have a readily identifiable visual signature.

In addition to the need for a broadband, man-carried antenna that does not have a readily identifiable visual signature, a primary requirement for any antenna is safety. This safety pertains to radiation hazards to persons, ordnance, and fuel. A person's maximum exposure to electromagnetic fields, as defined by standards adopted by the Department of Defense, the Department of the Navy, and the Institute of Electrical and Electronics Engineers (IEEE), depends upon the frequency, volume of body exposed, and length of time of exposure. Thus, it may be appreciated that an antenna incorporated into a garment must be safe for any input power and frequency with which it will be used since the antenna will be in close proximity to, at least, the radio operator. Therefore, a need exists for a broadband, man-carried antenna that does not have a readily identifiable visual signature and that maintains acceptable RF energy absorption levels.

SUMMARY OF THE INVENTION

The invention is directed to an ultra-broadband antenna that is incorporated into an electrically nonconductive garment and includes radiation absorber material to mitigate radiation hazards. The antenna operates over a frequency range of about 35–500 MHz.

The antenna is integrated into a garment so that the antenna offers no distinctive visual signature that would identify the person wearing the antenna garment as a radio operator. The garment is made of an electrically nonconductive material. The antenna includes first and second radio frequency (RF) elements attached to the garment so that a gap exists between them, where the RF elements each form a band when the garment is worn by a wearer. RF and ground feeds are electrically connected to the first and second RF elements, respectively. A shorting strap electrically connected between the first and second RF elements on the anterior side of the garment generally opposite the feed helps match the antenna impedance to an external device, such as a signal generator. The gap provides a voltage difference between the RF elements when the antenna is energized. Electrically conductive straps that extend over the shoulder regions of the garment are electrically connected between the anterior and dorsal regions of the first RF element. An impedance matching circuit electrically connected between the first RF element and the RF feed may be employed to approximately match the impedance of the antenna with an external device and the wearer to optimize the efficiency of the antenna for a particular operating band.

To mitigate radiation hazards posed by the antenna to the human wearer, radiation absorber material is disposed along the length and width of the gap between the RF elements. In addition, radiation absorber material is disposed in a pocket sewn on the inside layer of the antenna garment in the region of the RF feed.

These and other advantages of the invention will become more apparent upon review of the accompanying drawings and specification, including the claims.

BRIEF DESCRIPTION OF THE DRAWINGS

For a more complete understanding of this invention, reference is now made to the following detailed description of the embodiments as illustrated in the accompanying drawings wherein.

(a)

(b)

(c)

(d)

Throughout the several views, like elements are referenced using like references.

DESCRIPTION OF THE PREFERRED EMBODIMENT

Figure 1:
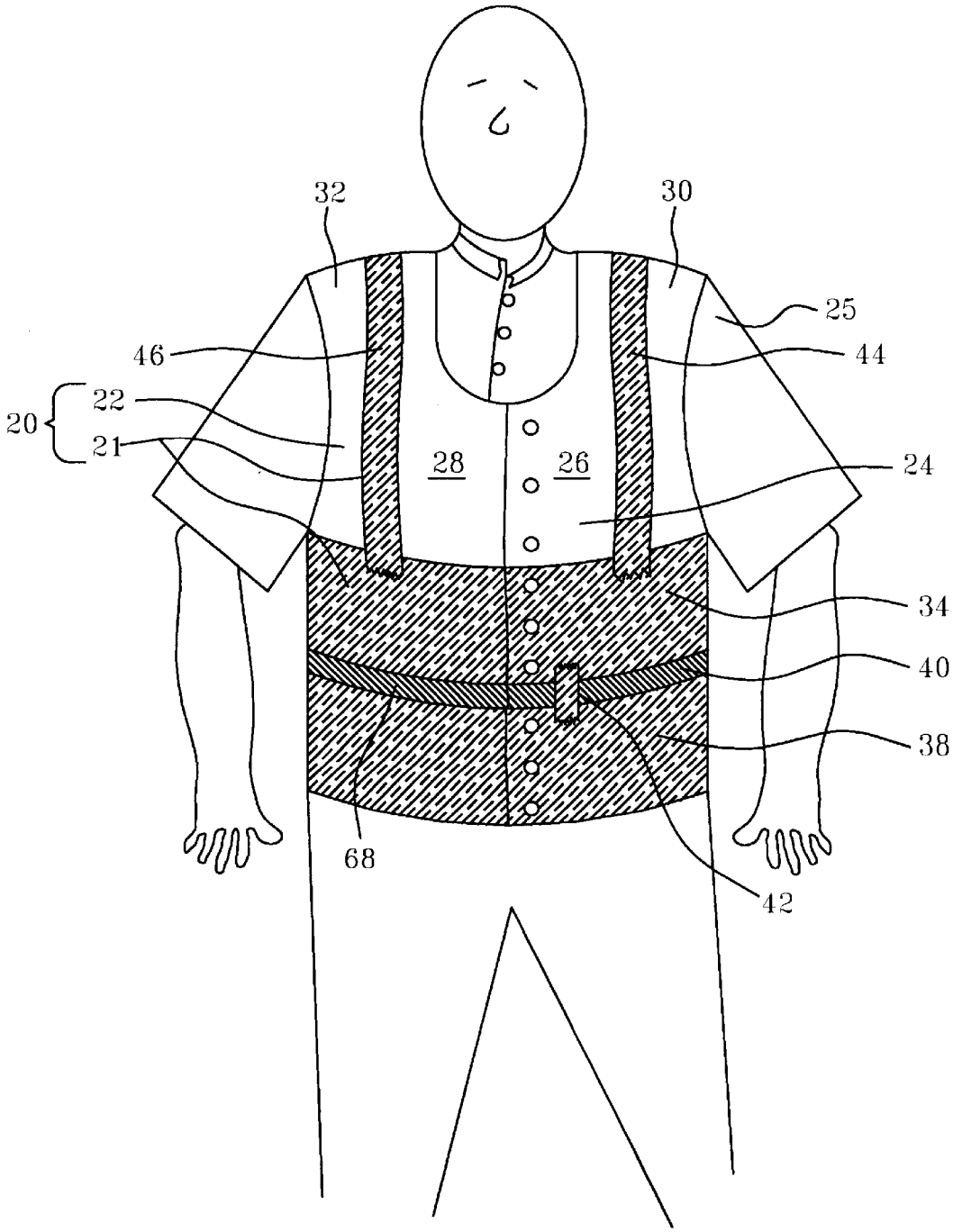
FIG. 1 illustrates an anterior view of a wide band antenna incorporated into a garment as shown worn by a wearer.
Figure 2:
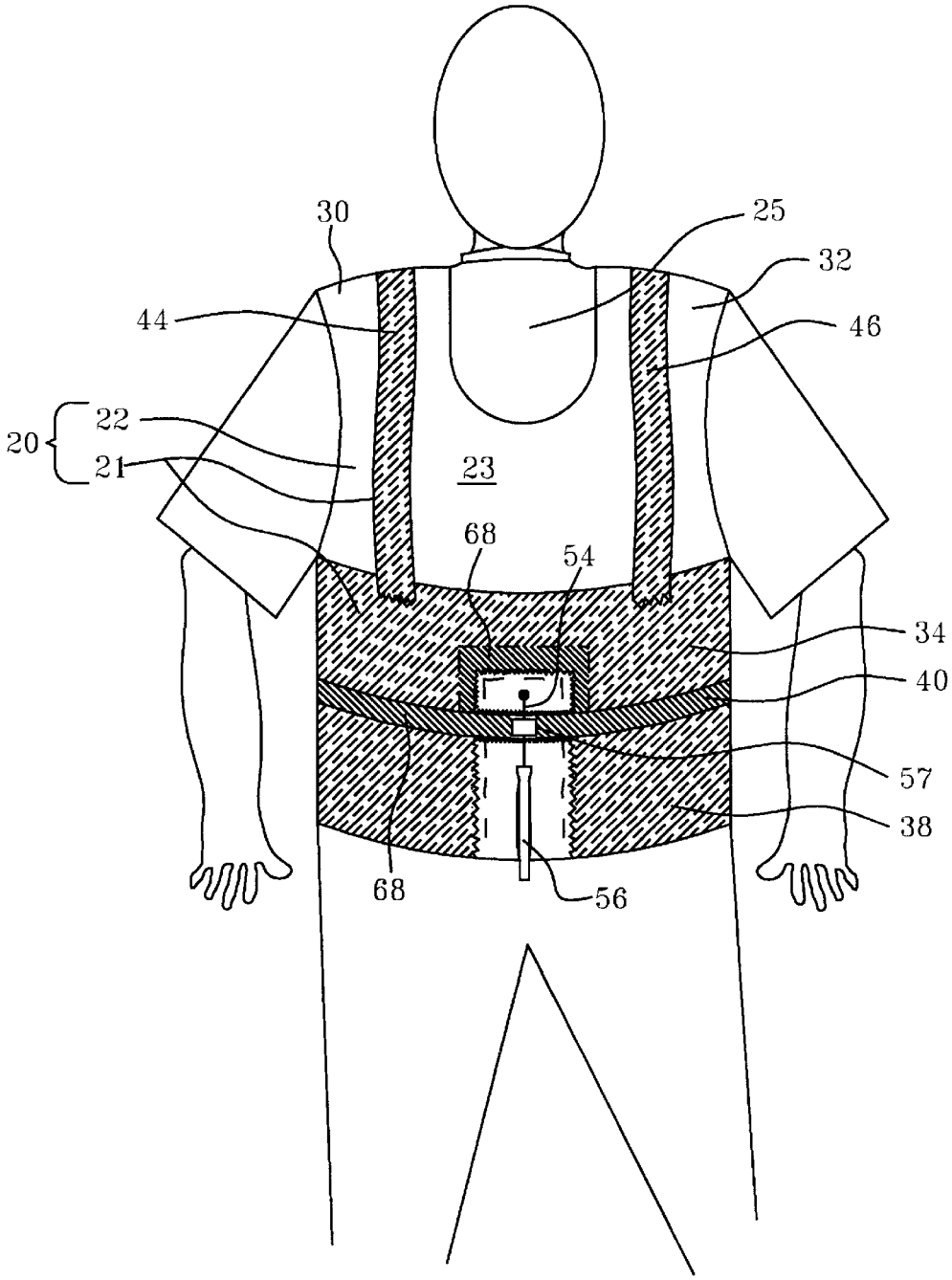
FIG. 2 shows a dorsal view of the antenna garment shown in FIG. 1.
Figure 3:
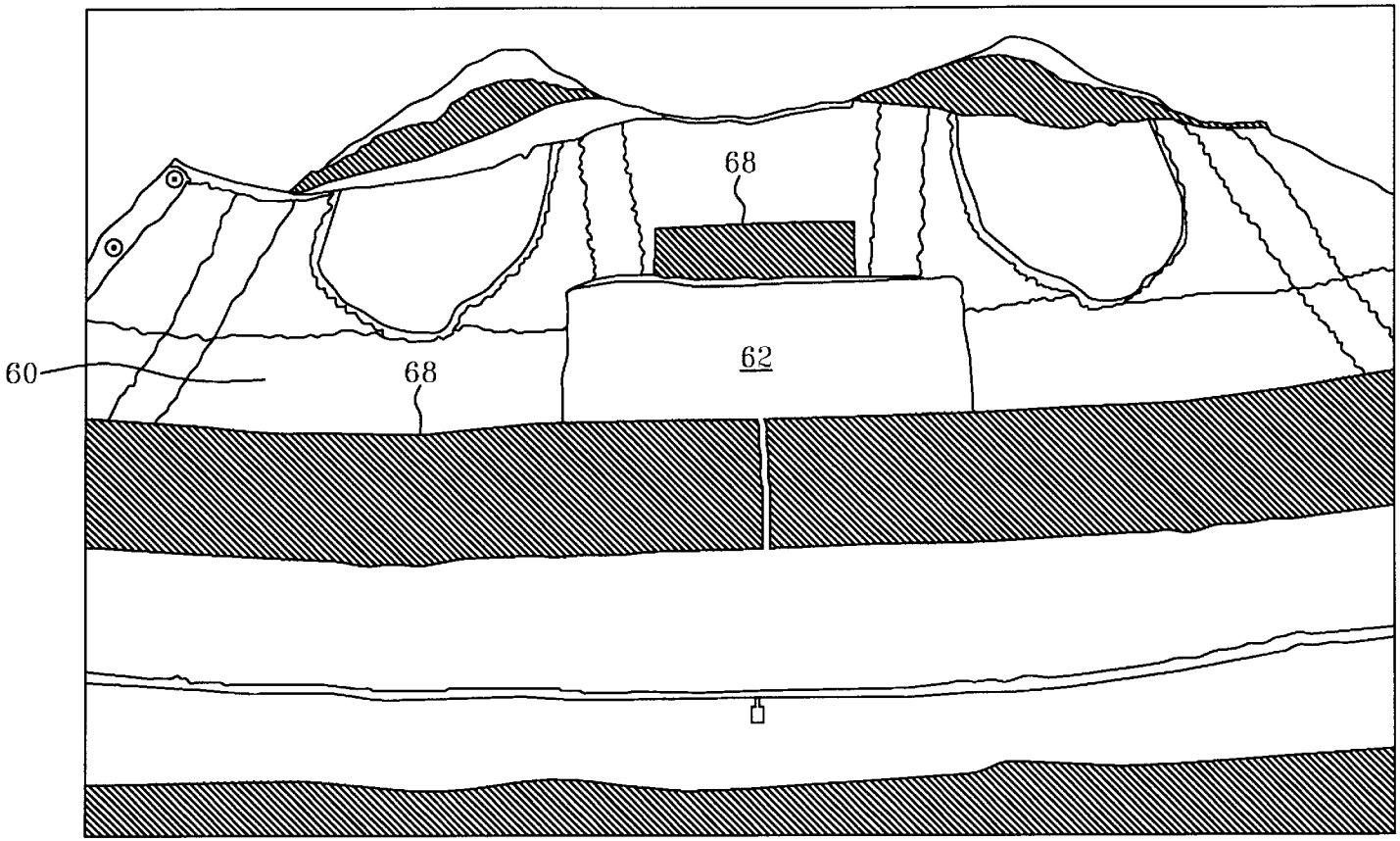
FIG. 3 shows an interior view of the antenna garment with anechoic material disposed within the inner layer of the garment.

Referring to FIGS. 1, 2, and 3 collectively, an antenna garment 20 worn by a human wearer 25 is shown that includes an ultra-broadband antenna 21 integrated into a garment 22 and radiation absorber material 68 disposed within antenna 21. Antenna 21 operates very efficiently over a frequency range of about 35–500 MHz.

Antenna 21 is integrated into garment 22 so that antenna 21 offers no distinctive visual signature that would identify the person wearing antenna garment 20 as a radio operator. Garment 22 is made of an electrically nonconductive material such as a woven fabric selected from the group that includes cotton, wool, polyester, nylon, Kevlar, rayon, and the like. Garment 22 has an outer layer 10 with an anterior or front section 24 and a dorsal or back region 23. From the perspective of the human wearer 25, front section 24 of garment 22 includes a left anterior front section 26 and a right anterior front section 28. Garment 22 also has a left shoulder section 30 and a right shoulder section 32. Antenna 21 includes a first radio frequency (RF) element 34, a second RF element 38, a shorting strap 42, left shoulder strap 44, right shoulder strap 46, RF feed 54, ground feed 56, and impedance matching circuit 57, all of which are attached to the garment 22. RF elements 34 and 38 are attached to garment 22 so that the RF elements are separated by a gap 40.

Radiation absorber material 68 is disposed within antenna 21 to mitigate the radiation hazards posed by antenna garment 20 to the human wearer 25. Measurements of the electric fields within antenna garment 20 indicated that gap 40 allowed the electric field to leak into the human wearer 25. For frequencies below 90 MHz, the electric fields in the area near RF feed 54 were higher than those allowed by the IEEE standards for whole-body exposure.

Referring now to FIG. 3, the inside layer 60 of antenna garment 20 is shown. In the preferred embodiment, a pocket 62 has been sewn on the inside layer of antenna garment 20 in the region of RF feed 54. Radiation absorber material 68, such as anechoic foam, is disposed in pocket 62. Radiation absorber material 68 is also disposed over the length and width of gap 40 that separates RF elements 34 and 38. Radiation absorber material 68 absorbs the electromagnetic fields within antenna garment 20 and limits the wearer's exposure to acceptable absorption levels.

Figure 4:
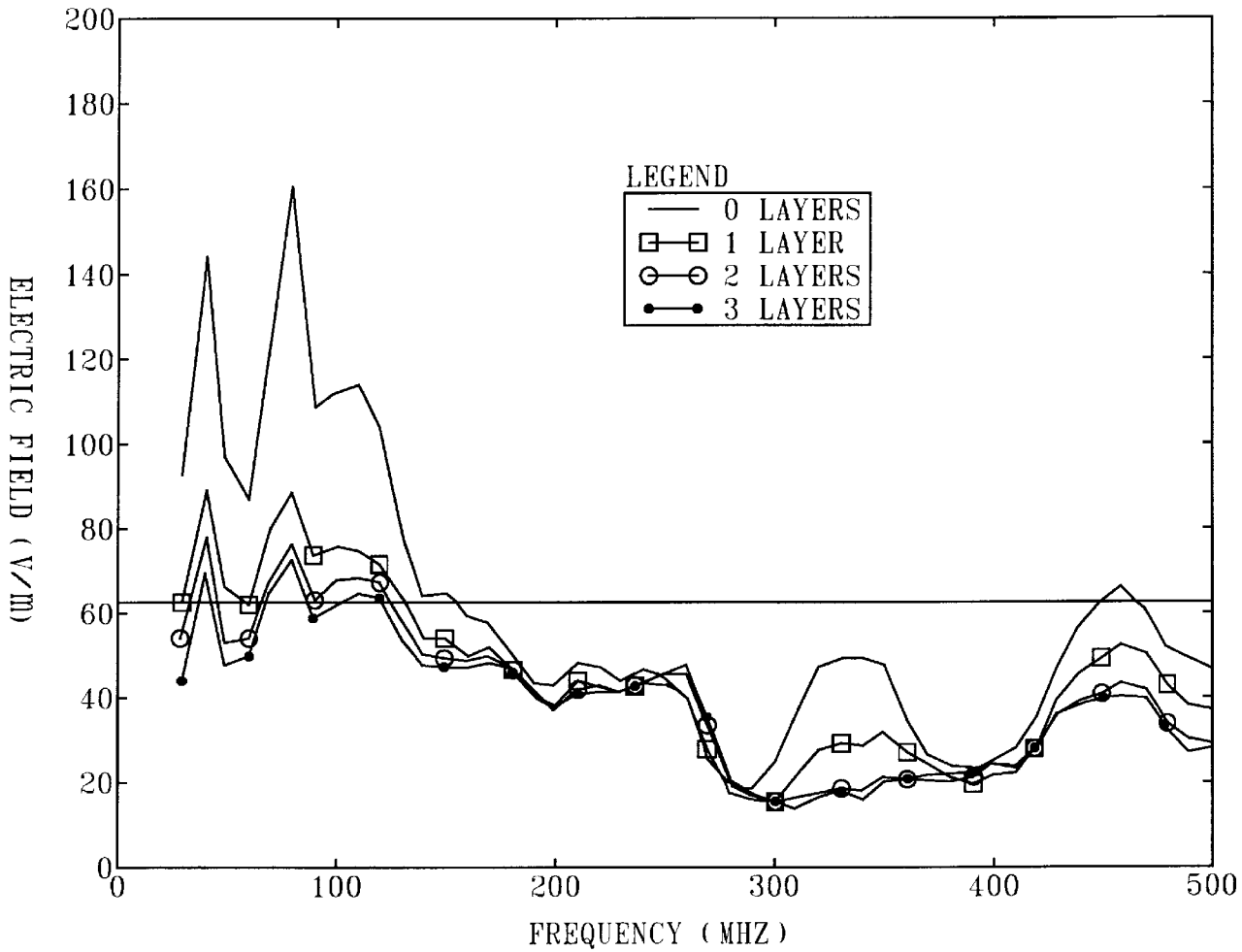
FIG. 4 shows the effect on electric fields with anechoic foam disposed behind the RF feed on electric fields; and (e)

FIG. 4 shows the electric fields within antenna garment 20 for an effective input power of 3 W as the number of layers of radiation absorber material 68 disposed in pocket 62 in the region of RF feed 54 is increased. As also shown in FIG. 4, 61.4 V/m is the maximum permissible exposure level set by the IEEE for a controlled environment. Although the electric field within antenna garment 20 is reduced as the number of layers of radiation material 68 disposed in pocket 62 is increased from one, two, and three layers, the electric field is not within the maximum permissible exposure level for all frequencies within the frequency range of antenna garment 20.

Figure 5:
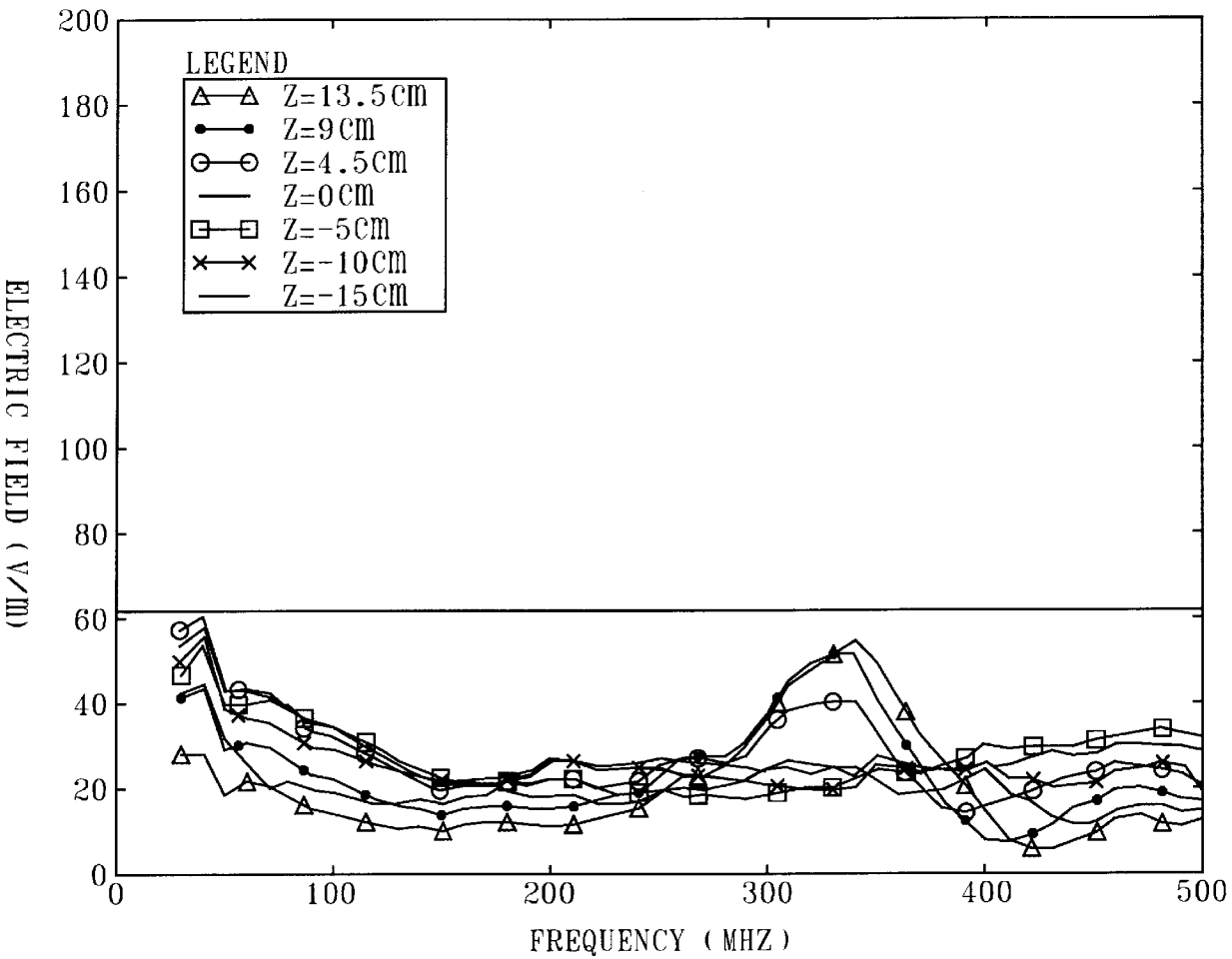
FIG. 5 shows-the effect on electric fields with anechoic foam disposed behind the RF feed and along the gap.

FIG. 5 shows the electric fields within antenna garment 20 for input power of 3 W as function of frequency and distance along the centerline above or below RF feed 54. Radiation absorber material 68, disposed over the length and width of gap 40 and in pocket 62, mitigates the radiation hazards posed by antenna garment 20 and reduces the electric fields below the maximum permissible exposure level for all frequencies within the frequency range of antenna garment 20.

Clearly, many modifications and variations of the invention are possible in light of the above teachings. It is therefore to be understood that within the scope of the appended claims, the invention may be practiced otherwise than as specifically described.

We claim:

1. An antenna garment comprising:

an electrically nonconductive garment having outer and inner layers, anterior and dorsal regions, and first and second shoulder regions;

an antenna that includes:

a first RF element attached to said garment;

a second RF element attached to said garment so that a gap exists between said first and second RF elements;

an RF feed electrically connected to said first RF element for providing RF energy to said first RF element;

a ground feed electrically connected to said second RF element;

a first shorting strap that electrically connects said first and second RF elements on said anterior side of said garment;

a first strap electrically connected between said anterior and dorsal regions of said first RF element and which extends over a first shoulder region of said garment;

a second strap electrically connected between said anterior and dorsal regions of said first RF element and which extends over a second shoulder region of said garment; and a matching circuit electrically connected between said first RF element and said RF feed; and radiation absorber material disposed within said antenna.

2. The antenna garment of claim 1 wherein said radiation absorber material is disposed over said gap between first and second RF elements of said antenna.

3. The antenna garment of claim 1 wherein said radiation absorber material is disposed on the inside layer of said antenna garment opposed to region of said RF feed.

* * * * *